US005964578A

United States Patent [19]

Suitou et al.

[11] Patent Number: 5,964,578

[45] Date of Patent: Oct. 12, 1999

[54] CONTROL VALVE IN VARIABLE DISPLACEMENT COMPRESSOR

[75] Inventors: Ken Suitou; Masahiro Kawaguchi; Masanori Sonobe; Tetsuhiko Fukanuma, all of Kariya; Norio Uemura; Kazuaki Nagayoski, both of Fujisawa; Ichiro Hirata, Sagamihara; Kouji Watanabe, Kamakura, all of Japan

[73] Assignee: Kabushiki Kaisha Toyoda Jidoshokki Seisakusho, Aichi-ken, Japan

[21] Appl. No.: 08/829,641

[22] Filed: Mar. 31, 1997

[30] Foreign Application Priority Data

Apr. 1, 1996 [JP] Japan ..... 8-078781

[51] Int. Cl.[6] ..... F04B 1/29

[52] U.S. Cl. ..... 417/222.2

[58] Field of Search ..... 417/222.2, 269, 417/270, 222.1

[56] References Cited

U.S. PATENT DOCUMENTS

| | | | |
|---|---|---|---|
| 5,145,326 | 9/1992 | Kimura et al. | 417/222.2 |
| 5,531,572 | 7/1996 | Kimura et al. | 417/222.2 |
| 5,586,870 | 12/1996 | Kawaguchi et al. | 417/222.2 |
| 5,702,235 | 12/1997 | Hirota et al. | 417/222.2 |
| 5,785,502 | 7/1998 | Ota et al. | 417/222.2 |

FOREIGN PATENT DOCUMENTS

| | | |
|---|---|---|
| 068722A1 | 12/1994 | European Pat. Off. . |
| 323385 | 1/1991 | Japan . |
| 626454 | 2/1994 | Japan . |
| 6346845 | 12/1994 | Japan . |

*Primary Examiner*—Charles G. Freay
*Assistant Examiner*—Robert Z. Evora
*Attorney, Agent, or Firm*—Morgan & Finnegan, L.L.P.

[57] ABSTRACT

A control valve in a compressor that adjusts the discharge displacement based on controlling of an inclination of a cam plate. The compressor includes a supply passage for connecting a discharge chamber with a crank chamber. The control valve is placed midway on the supply passage. The control valve has a valve body. The valve body moves in a first direction to open the supply passage and moves in the second direction to close the supply passage. A reacting member reacts to suction pressure. A first transmitting member is placed between the reacting member and the valve body. A solenoid is opposed to the reacting member with respect to the valve body. The solenoid urges the valve body in the second direction via a second transmitting member when the solenoid is excited. An urging device urges the valve body in the first direction, The first transmitting member connects the reacting member with the valve body to move the valve body toward or away from the reacting member. The urging device causes the valve body to fully open the supply passage when the solenoid is de-exited.

18 Claims, 6 Drawing Sheets

CONTROL VALVE IN VARIABLE DISPLACEMENT COMPRESSOR

BACKGROUND OF THE INVENTION

1. Field of the Invention

The present invention relates to a displacement control valve incorporated in variable displacement compressors that are used in vehicle air conditioners. More particularly, the present invention relates to a displacement control valve that controls the flow rate of refrigerant gas between discharge and crank chambers.

2. Description of the Related Art

A typical variable displacement compressor has a cam plate that is tiltably supported on a drive shaft. The inclination of the cam plate is controlled based on the difference between the pressure in a crank chamber and the pressure in cylinder bores. The stroke of each piston is varied by the inclination of the cam plate. Accordingly, the displacement of the compressor is varied and determined by the stroke of each piston. The compressor is provided with a discharge chamber and a crank chamber that are connected by a supply passage. A displacement control valve is located in the supply passage. The displacement control valve controls the flow rate of refrigerant gas from the discharge chamber to the crank chamber, thereby controlling the pressure in the crank chamber. Accordingly, the difference between the pressure in the crank chamber and the pressure in the cylinder bores is controlled by the control valve.

Japanese Unexamined Patent Publication No 6-346845 discloses such a displacement control valve used in a variable displacement compressor. As shown in FIG. 6, a control valve 101 includes a housing 102 and a housing 103 that are secured to each other. The solenoid 102 includes a fixed steel core 105, a steel plunger 106 and a coil 104. The plunger 106 moves closer to and away from the fixed core 105. The coil 104 is wound around the plunger 106 and the fixed core 105. A first spring 107 extends between the fixed core 105 and the plunger 106.

A valve chamber 108 and a pressure sensing chamber 115 are defined at the upper portion and at the lower portion of the hosing 103, respectively. The housing 103 has a first port 110, a second port 111 and a third port 112. The valve chamber 108 is connected to the discharge pressure area of the compressor by the first port 110, which opens in the ceiling of the valve chamber 108. The valve chamber 108 is also connected to the crank chamber in the compressor by a valve hole 114 formed in the bottom of the valve chamber 108, the third port 112 and the supply passage. The pressure sensing chamber 115 is connected to the suction pressure area of the compressor by the second port 111. The first port 110, the valve chamber 108, the valve hole 114 and the third port 112 constitute a part of the supply passage. A valve body 109 is provided in the valve chamber 108. A second spring 113 provided in the valve chamber 108 urges the valve body 109 in a direction closing the valve hole 114. A bellows 116 is provided in the pressure sensing chamber 115.

Suction pressure Ps in the suction pressure area of the compressor is introduced to the pressure sensing chamber 115 by the second port 111. The bellows 116 in the pressure sensing chamber 115 is expanded and collapsed in accordance with the suction pressure. The bellows 116 is attached to the plunger 106 in the solenoid 102. A rod 117 is secured to the top of the bellows 116. The distal end of the rod 117 contacts with the valve body 109 in the valve chamber 108. Changes in the length of the bellows 116 are transmitted to the valve body 109 by the rod 117. The valve body 109 opens and closes the valve hole 114, accordingly. In other words, the valve body 109 opens and closes the supply passage, which connects the discharge pressure area with the crank chamber, in accordance with changes in the suction pressure Ps in the pressure sensing chamber 115.

The solenoid 104 is excited and de-excited by an external control computer (not shown). The computer is connected to various devices including an air conditioner starting switch, an engine speed sensor, a temperature sensor for detecting the temperature of the evaporator in the external refrigerant circuit, a compartment temperature sensor, and a temperature adjuster. A passenger sets a target compartment temperature by the temperature adjuster. The computer inputs data relating to the ON/OFF state of the starting switch, an engine speed, an evaporator temperature, a compartment temperature, and a target compartment temperature. Based on the inputted data, the computer excites and de-excites the solenoid 104.

When the solenoid 104 is excited, the plunger 106 is attracted to the fixed core 105 against the force of the first spring 107. This movement of the plunger 106 is transmitted to the valve body 109 by the bellows 116 and the rod 117, thereby moving the valve body 109 toward the valve hole 114. In this state, if suction pressure Ps is high, that is, if the cooling load is great, the bellows 116 collapses and pulls the valve body 109. This decreases the opening area of the valve hole 114. Contrarily, if the suction pressure Ps is low, that is, if the cooling load is small, the bellows 116 expands and pushes the valve body 109. This increases the opening area of the valve hole 114.

When the solenoid 104 is de-excited, there is no magnetic attractive force between the plunger 106 and the fixed core 105. The plunger 106 is thus moved by the force of the first spring 107 away from the fixed core 105. This movement of the plunger 106 is transmitted to the valve body 109 by the bellows 116 and the rod 117, thereby moving the valve body 109 away from the valve hole 114. This maximizes the opening area of the valve hole 114.

The valve body 109 and the rod 117 are constantly in contact with each other by the forces of the first spring 107 and the second spring 113. This permits an integral movement of the valve body 109, the rod 117 and the bellows 116.

The heat exchange capacity of the evaporator in the external refrigerant circuit is extremely low, for example, when the outside temperature is high and the vehicle speed is low. In this case, if the compressor is operating at the maximum displacement, the discharge pressure Pd in the discharge pressure area becomes extremely high. The suction pressure Ps, which is introduced to the pressure sensing chamber 115, also becomes extremely high. This collapses the bellows 116. If the starting switch is turned off, t computer de-excites the solenoid 104 to minimize the compressor's displacement. In this state, the valve body 109 needs to be at such a position that the opening area of the valve hole 114 is maximized. However, the high suction pressure Ps in the pressure sensing chamber 115 keeps the bellows 116 collapsed. Further, the valve body 109 is moved integrally with the bellows 116. Therefore, it is hard to keep the valve body 109 at a position for maximizing the opening area of the valve hole 114.

SUMMARY OF THE INVENTION

Accordingly, it is an objective of the present invention to provide a control valve used in variable displacement compressors, which valve keeps the valve body in such a position that the opening area of the valve hole is maximized even if suction pressure is high.

To achieve the above objective, the present invention discloses a control valve in a variable displacement compressor that adjusts the discharge displacement based on controlling of an inclination of a cam plate located in a crank chamber. The compressor includes a piston operably coupled to the cam plate and located in a cylinder bore. The piston compresses gas supplied to the cylinder bore from a first area and discharges the compressed gas to a second area. The inclination of the cam plate is variable based on the pressure in the crank chamber. The compressor includes a supply passage for connecting the second area with the crank chamber. The control valve is placed midway on the supply passage for adjusting the amount of the gas introduced into the crank chamber from the second area through the supply passage to control the pressure in the crank chamber. The control valve comprises a valve body for adjusting the opening size of the supply passage. The valve body is movable in a first direction and a second direction opposite to the first direction. The valve body moves in the first direction to open the supply passage. The valve body moves in the second direction to close the supply passage. A reacting member reacts to the pressure in the first area. A first transmitting member is placed between the reacting member and the valve body. The reacting member moves the valve body in the second direction via the first transmitting member in accordance with raising of the pressure in the first area. A solenoid is opposed to the reacting member with respect to the valve body. A second transmitting member is placed between the solenoid and the valve body. The solenoid urges the valve body in the second direction via the second transmitting member when the solenoid is excited. Urging means urges the valve body in the first direction. The first transmitting member connects the reacting member with the valve body to move the valve body toward or away from the reacting member. The urging means causes the valve body to fully open the valve hole when the solenoid is de-excited.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

A variable displacement compressor control valve according to a first embodiment of the present invention will now be described with reference to FIGS. 1 to 5.

Figure 2:
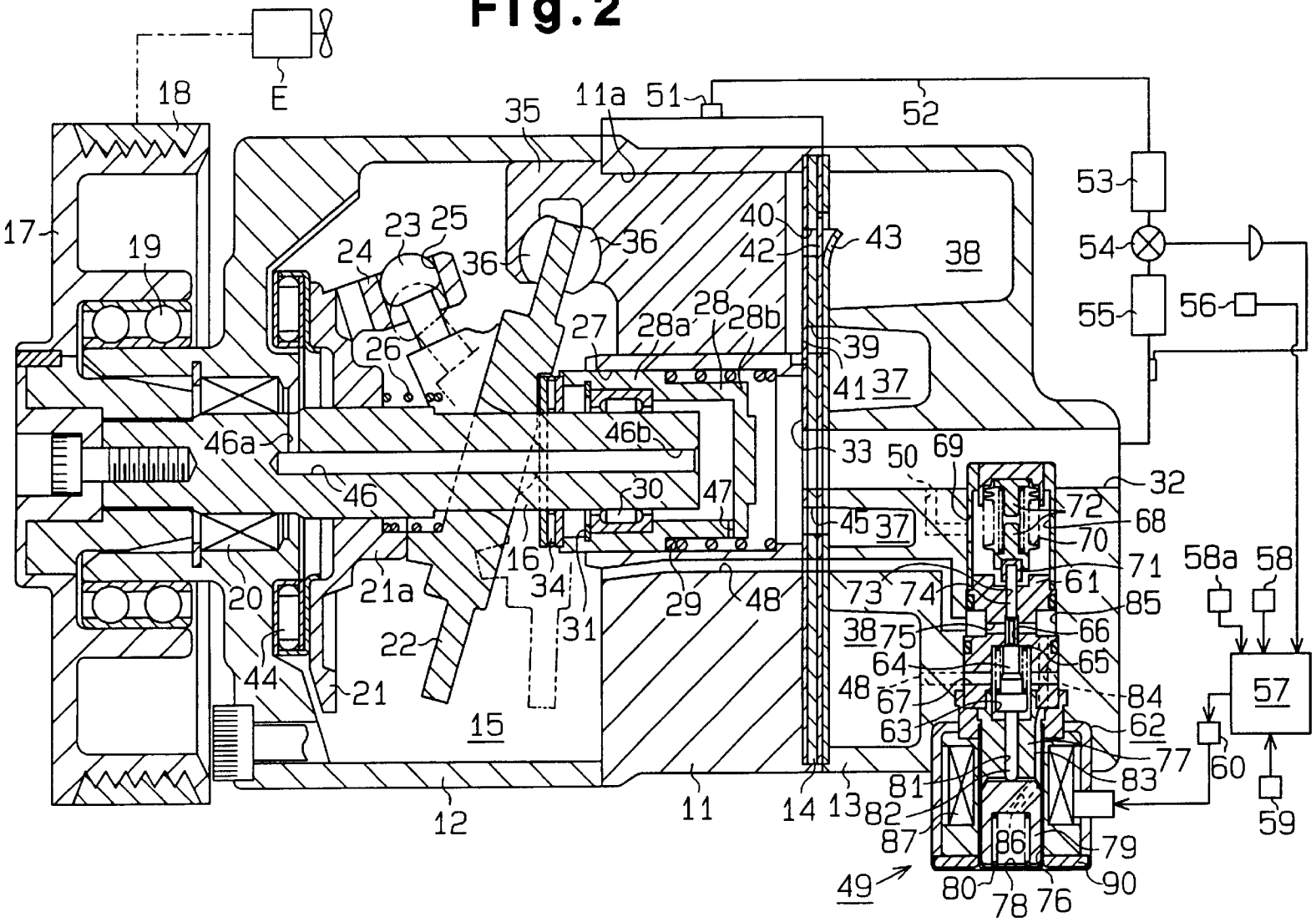
FIG. 2 is a cross-sectional view illustrating a variable displacement compressor having the control valve of FIG. 1.

Firstly, the structure of a variable displacement compressor will be described. As shown in FIG. 2, a front housing 12 is secured to the front end face of a cylinder block 11. A rear housing 13 is secured to the rear end face of the cylinder block 11 with a valve plate 14. A crank chamber 15 is defined by the inner walls of the front housing 12 and the front end face of the cylinder block 11.

A drive shaft 16 is rotatably supported in the front housing 12 and the cylinder block 11. The front end of the drive shaft 16 protrudes from the crank chamber 15 and is secured to a pulley 17. The pulley 17 is directly coupled to an external drive source (a vehicle engine E in this embodiment) by a belt 18. The compressor of this embodiment is a clutchless type variable displacement compressor having no clutch between the drive shaft 16 and the external drive source. The pulley 17 is supported by the front housing 12 with an angular bearing 19. The angular bearing 19 transfers thrust and radial loads that act on the pulley 17 to the housing 12.

A lip seal 20 is located between the drive shaft 16 and the front housing 12 for sealing the crank chamber 15.

A substantially disk-like swash plate 22 is supported by the drive shaft 16 in the crank chamber 15 to be slidable along and tiltable with respect to the axis of the shaft 16. The swash plate 22 is provided with a pair of guiding pins 23, each having a guide ball at the distal end. The guiding pins 23 are fixed to the swash plate 22. A rotor 21 is fixed to the drive shaft 16 in the crank chamber 15. The rotor 21 rotates integrally with the drive shaft 16. The rotor 21 has a support arm 24 protruding toward the swash plate 22. A pair of guide holes 25 are formed in the support arm 24. Each guide pin 23 is slidably fitted into the corresponding guide hole 25. The cooperation of the arm 24 and the guide pins 23 permits the swash plate 22 to rotate together with the drive shaft 16. The cooperation also guides the tilting of the swash plate 22 and the movement of the swash plate 22 along the axis of the drive shaft 16. As the swash plate 22 slides backward toward the cylinder block 11, the inclination of the swash plate 22 decreases.

A coil spring 26 is located between the rotor 21 and the swash plate 22. The spring 26 urges the swash plate 22 backward, or in a direction to decrease the inclination of the swash plate 22. The rotor 21 is provided with a projection 21*a* on its rear end face. The abutment of the swash plate 22 against the projection 21*a* prevents the inclination of the swash plate 22 beyond the predetermined maximum inclination.

Figure 3:
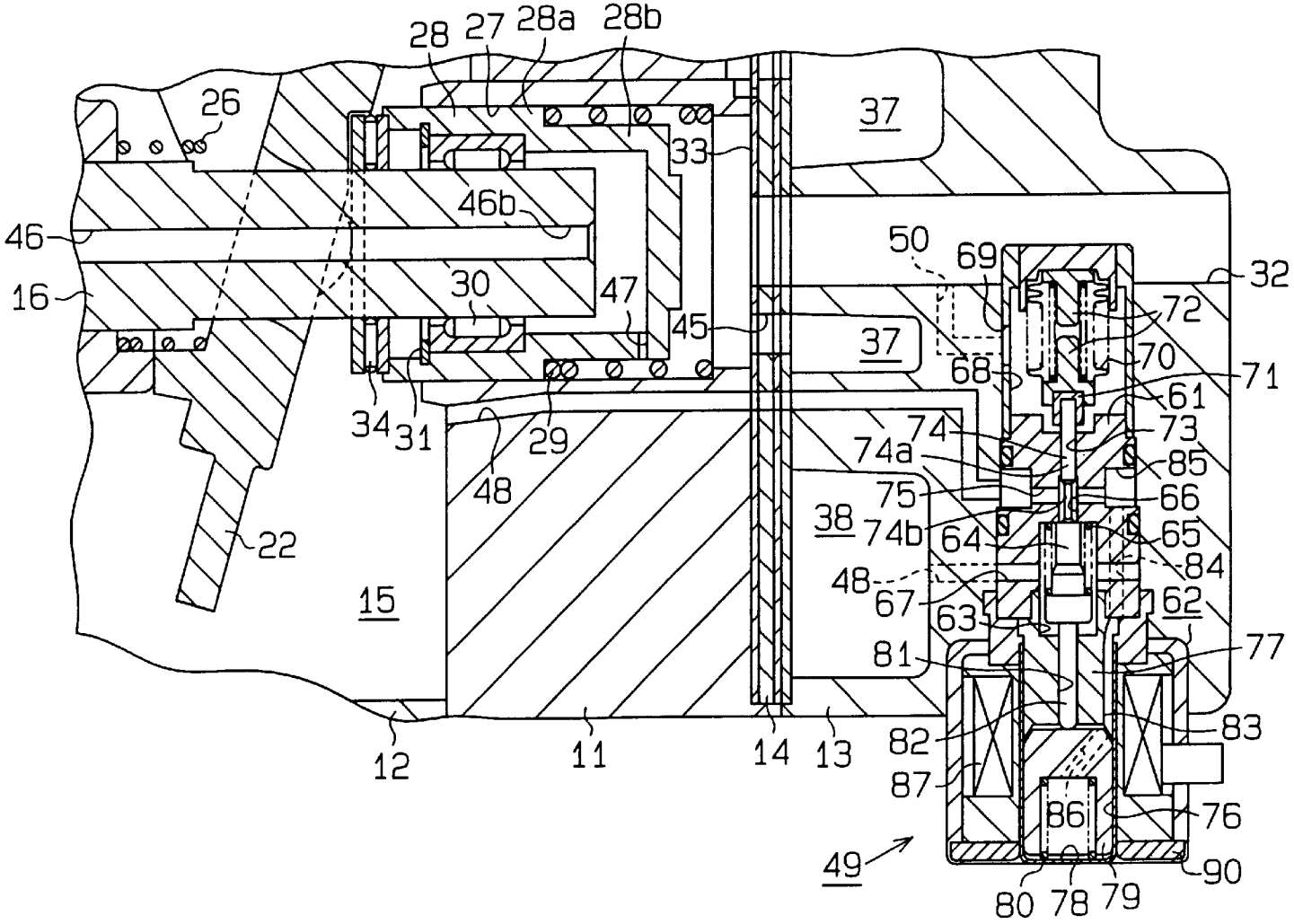
FIG. 3 is an enlarged partial cross-sectional view illustrating a compressor when a solenoid is excited.
Figure 4:
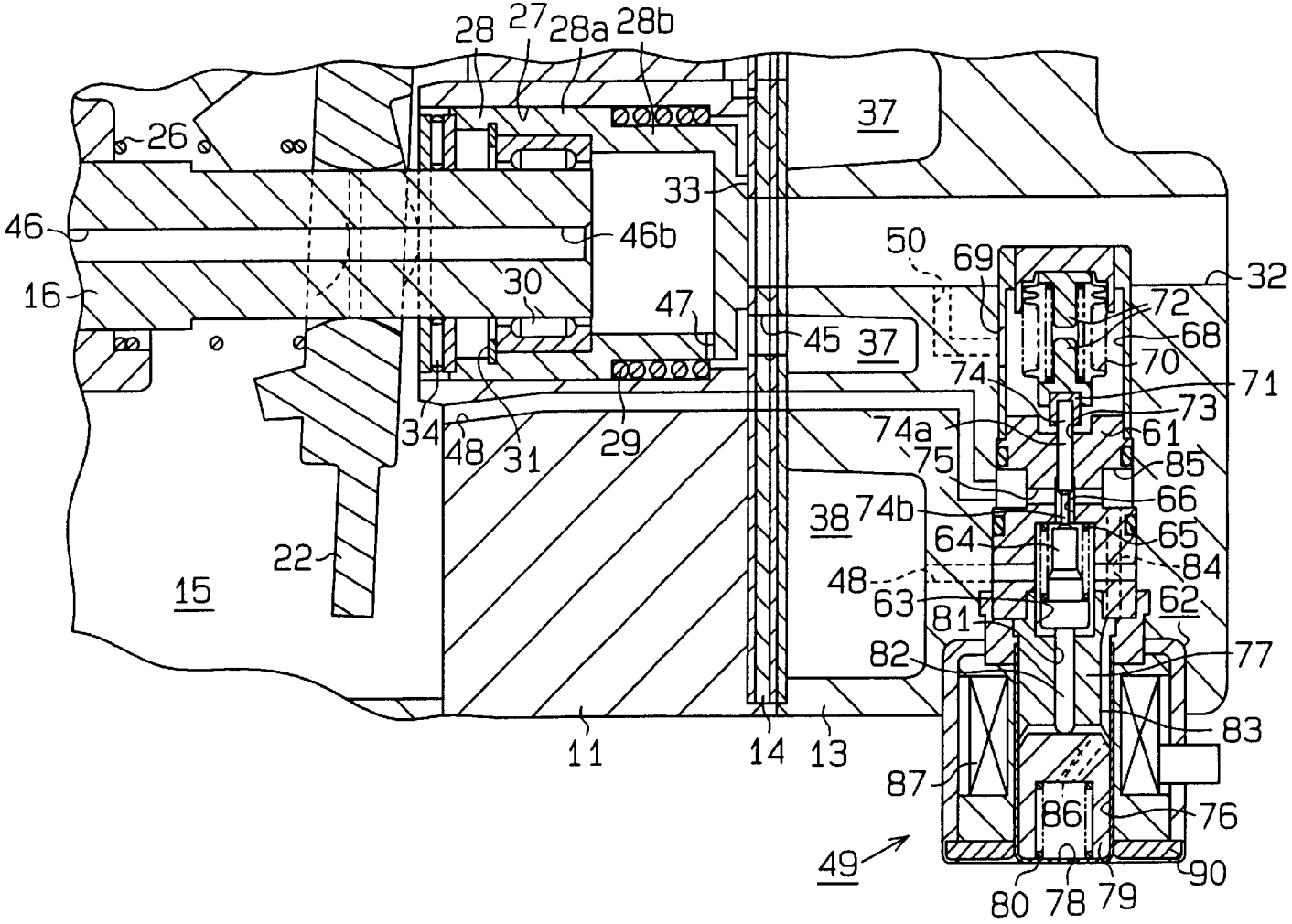
FIG. 4 is an enlarged partial cross-sectional view illustrating a compressor when the solenoid is de-excited.

As shown in FIGS. 2 to 4, a shutter chamber 27 is defined at the center portion of the cylinder block 11 extending along the axis of the drive shaft 16. A hollow cylindrical shutter 28 is accommodated in the shutter chamber 27. The shutter 28 slides along the axis of the drive shaft 16. The shutter 28 has a large diameter portion 28*a* and a small diameter portion 28*b*. A coil spring 29 is located between a step, which is defined between the large diameter portion 28*a* and the small diameter portion 28*b*, and a wall of the shutter chamber 27. The coil spring 29 urges the shutter 28 toward the swash plate 22.

The rear end of the drive shaft 16 is inserted in the shutter 28. The radial bearing 30 is fixed to the inner wall of the large diameter portion 28*a* of the shutter 30 by a snap ring 31. Therefore, the radial bearing 30 moves with the shutter 28 along the axis of the drive shaft 16. The rear end of the drive shaft 16 is supported by the inner wall of the shutter chamber 27 with the radial bearing 30 and the shutter 28 in between.

A suction passage 32 is defined at the center portion of the rear housing 13 and the valve plate 14. The passage 32 extends along the axis of the drive shaft 16 and is communicated with the shutter chamber 27. The suction passage 32 functions as a suction pressure area. A positioning surface 33 is formed on the valve plate 14 about the inner opening of the suction passage 32. The rear end of the shutter 28 abuts against the positioning surface 33. Abutment of the shutter 28 against the positioning surface 33 prevents the shutter 28 from further moving backward away from the rotor 21. The abutment also disconnects the suction passage 32 from the shutter chamber 27.

A thrust bearing 34 is supported on the drive shaft 16 and is located between the swash plate 22 and the shutter 28. The thrust bearing 34 slides along the axis of the drive shaft 16. The force of the coil spring 29 constantly retains the thrust bearing 34 between the swash plate 22 and the shutter 28. The thrust bearing 34 prevents the rotation of the swash plate 22 from being transmitted to the shutter 28.

The swash plate 22 moves backward as its inclination decreases. As it moves backward, the swash plate 22 pushes the shutter 28 backward through the thrust bearing 34. Accordingly, the shutter 28 moves toward the positioning surface 33 against the force of the coil spring 29. As shown in FIG. 4, when the swash plate 22 reaches the minimum inclination, the rear end of the shutter 28 abuts against the positioning surface 33. In this state, the shutter 28 is located at the closed position for disconnecting the shutter chamber 27 from the suction passage 32.

A plurality of cylinder bores 11*a* extend through the cylinder block 11 and are located about the axis of the drive shaft 16. The cylinder bores 11*a* are spaced apart at equal intervals. A single-headed piston 35 is accommodated in each cylinder bore 11*a*. A pair of semispherical shoes 36 are fitted between each piston 35 and the swash plate 22. A semispherical portion and a flat portion are defined on each shoe 36. The semispherical portions slidably contact the piston 35 while the flat portions slidably contact the swash plate 22. The swash plate 22 is rotated by the drive shaft 16 through the rotor 21. The rotating movement of the swash plate 22 is transmitted to each piston 35 through the shoes 36 and is converted to linear reciprocating movement of each piston 35 in the associated cylinder bore 11*a*.

An annular suction chamber 37 is defined in the rear housing 13. The suction chamber 37 is communicated with the shutter chamber 27 via a communication hole 45. An annular discharge chamber 38 is defined around the suction chamber 37 in the rear housing 13. Suction ports 39 and discharge ports 40 are formed in the valve plate 14. Each suction port 39 and each discharge port 40 correspond to one of the cylinder bores 11*a*. Suction valve flaps 41 are formed on the valve plate 14. Each suction valve flap 41 corresponds to one of the suction ports 39. Discharge valve flaps 42 are formed on the valve plate 14. Each discharge valve flap 42 corresponds to one of the discharge ports 40.

As each piston 35 moves from the top dead center to the bottom dead center in the associated cylinder bore 11*a*, refrigerant gas in the suction chamber 37 enters each piston bore 11*a* through the associated suction port 39 while causing the associated suction valve flap 41 to flex to an open position. As each piston 35 moves from the bottom dead center to the top dead center in the associated cylinder bore 11*a*, refrigerant gas is compressed in the cylinder bore 11*a* and discharged to the discharge chamber 38 through the associated discharge port 40 while causing the associated discharge valve flap 42 to flex to an open position. Retainers 43 are formed on the valve plate 14. Each retainer 43 corresponds to one of the discharge valve flaps 42. The opening amount of each discharge valve flap 42 is defined by contact between the valve flap 42 and the associated retainer 43.

A thrust bearing 44 is located between the front housing 12 and the rotor 21. The thrust bearing 44 carries the reactive force of gas compression acting on the rotor 21 through the pistons 35 and the swash plate 22.

A pressure release passage 46 is defined at the center portion of the drive shaft 16. The pressure release passage 46 has an inlet 46*a*, which opens to the crank chamber 15 in the vicinity of the lip seal 20, and an outlet 46*b*, which opens to the interior of the shutter 28. A pressure release hole 47 is formed in the peripheral wall near the rear endi of the shutter 28. The hole 47 communicates the interior of the shutter 28 with the shutter chamber 27.

A supply passage 48 is defined in the rear housing 13, the valve plate 14 and the cylinder block 11. The supply passage 48 communicates the discharge chamber 38 with the crank chamber 15. A displacement control valve 49 is accommodated in the rear housing 13 midway in the supply passage 48. A pressure introduction passage 50 is defined in the rear housing 13. The passage 50 communicates the control valve 49 with the suction passage 32, thereby introducing suction pressure Ps into the control valve 49.

An outlet port 51 is defined in the cylinder block 11 and is communicated with the discharge chamber 38. The outlet port 51 is connected to the suction passage 32 by an external refrigerant circuit 52. The external refrigerant circuit 52 includes a condenser 53, an expansion valve 54 and an evaporator 55. A temperature sensor 56 is located in the vicinity of the evaporator 55. The temperature sensor 56 detects the temperature of the evaporator 55 and issues signals relating to the detected temperature to a control computer 57. The computer 57 is connected to various devices including a temperature adjuster 58, a compartment temperature sensor 58*a*, and an air conditioner starting switch 59. A passenger sets a desirable compartment temperature, or a target temperature, by the temperature adjuster 58.

The computer 57 inputs signals relating to a target temperature from the temperature adjuster 58, a detected evaporator temperature from the temperature sensor 56, a detected compartment temperature from the temperature sensor 58*a*, and an ON/OFF state of the switch 59. Based on the inputted signals, the computer 57 commands the driving circuit 60 to send an electric current having a certain magnitude to the coil 86 of a solenoid 62 in the control valve 49. The solenoid 62 will be described later. In addition to the above listed data, the computer 57 may use other data such as the temperature outside the compartment and the engine speed E for determining the magnitude of electric current sent to the control valve 49.

The structure of the control valve 49 will now be described.

Figure 1:
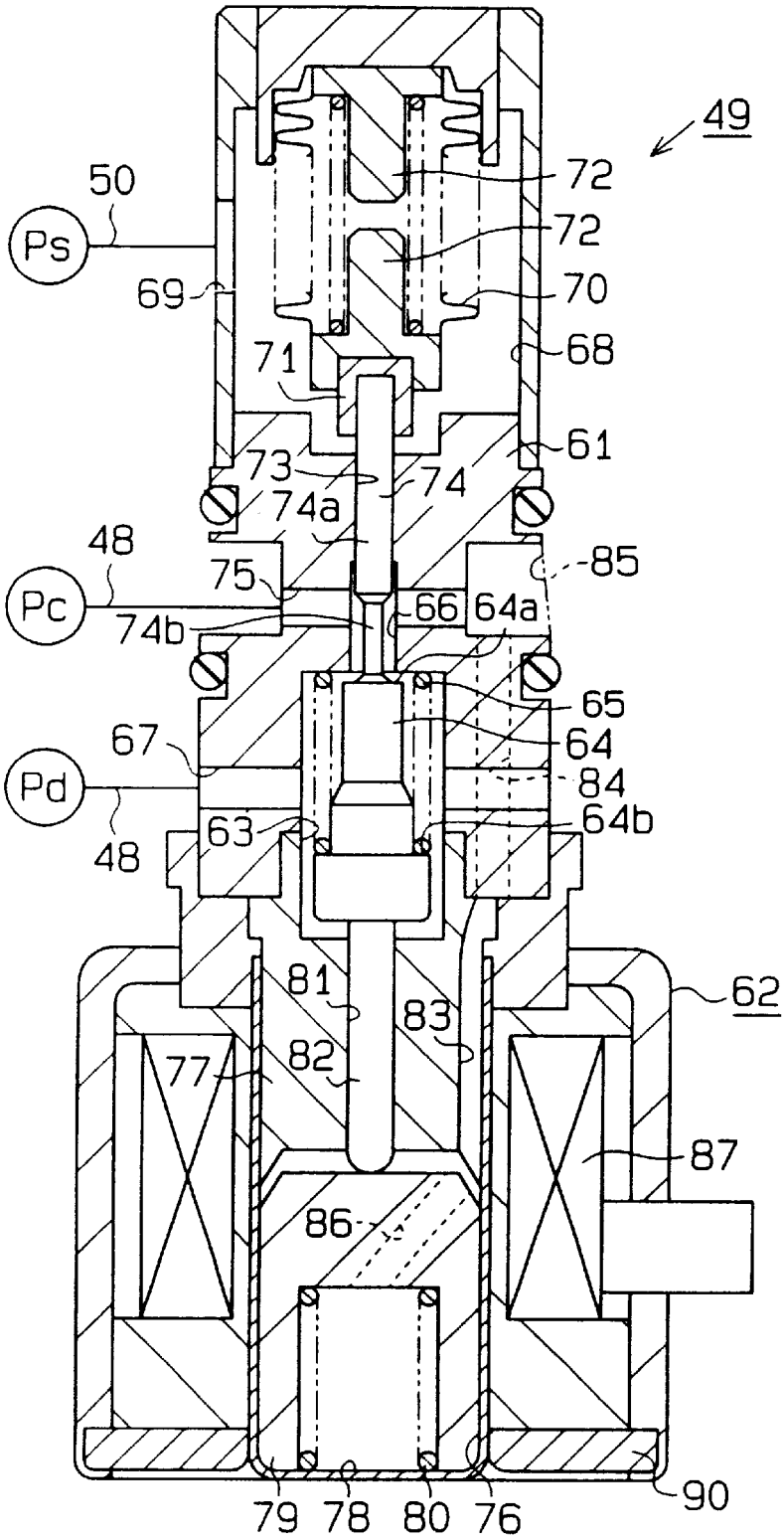
FIG. 1 is a cross-sectional view illustrating a control valve according to an embodiment of the present invention.

As shown in FIGS. 1 and 2, the control valve 49 includes a housing 61 and the solenoid 62, which are secured to each other. A valve chamber 63 is defined between the housing 61 and the solenoid 62. The valve chamber 63 is connected to the discharge chamber 38 by a first port 67 and the supply passage 48. A valve body 64 is arranged in the valve chamber 63. A valve hole 66 is defined extending axially in the housing 61 and opens in the valve chamber 63. The area about the opening of the valve hole 66 functions as a valve seat, against which a flat surface 64*a* of the valve body 64 contacts. A first coil spring 65 extends between a step 64*b* defined on the valve body 64 and a wall of the valve chamber 63.

A pressure sensing chamber 68 is defined at the upper portion of the housing 61. The pressure sensing chamber 68 is provided with a bellows 70 and is connected to the suction passage 32 by a second port 69 and the pressure introduction passage 50. Suction pressure Ps in the suction passage 32 is thus introduced to the chamber 68 via the passage 50. The bellows 70 functions as a pressure sensing member for detecting the suction pressure Ps. A cylindrical receiver 71 is secured to the lower end of the bellows 70. A pair of stoppers 72 are arranged facing each other in the bellows 70. Abutment of the stoppers 72 limits the collapse of the bellows 70.

A first guide hole 73 is defined in the housing 61 between the pressure sensing chamber 68 and the valve hole 66. The axis of the first guide hole 73 is aligned with the axis of the valve hole 66. A first rod 74 extends through the middle portion of the valve 49. The first rod 74 has a large diameter portion 74*a* and a small diameter portion 74*b*. The large diameter portion 74*a* extends through and slides with respect to the first guide hole 73. The upper end of the large diameter portion 74*a* is slidably inserted in the receiver 71. The small diameter portion 74*b* extends within the valve hole 66. The clearance between the small diameter portion 74*b* and the valve hole 66 permits the flow of refrigerant gas. The lower end of the small diameter portion 74*b* is attached to the valve body 64. In other words, the proximal end of the first rod 74 is attached to the valve body 64, while the distal end of the first rod 74 is slidably inserted in the receiver 71.

The first rod 74 and the receiver 71 connect the bellows 70 and the valve body 64 such that the distance between the valve body 64 and the receiver 71 is changeable. The distal end of the first rod 74 is slidably retained in the receiver 71 even if the bellows 70 and the valve body 64 are maximally separated. That is, the distal end of the first rod 74 is retained in the receiver 71 even if the bellows 70 is collapsed to the maximum degree and the valve body 64 is located at a position for maximizing the opening area of the valve 66.

A third port 75 is defined in the housing 61 between the valve chamber 63 and the pressure sensing chamber 68. The port 75 extends perpendicularly with respect to the valve hole 66. The valve hole 66 is connected to the crank chamber 15 by the third part 75 and the supply passage 48. The first port 67, the valve chamber 63, the valve hole 66 and the third port 75 constitute a part of the supply passage 48.

An accommodating hole 76 is defined in the center portion of the solenoid 62. A fixed steel core 77 is fitted in the upper portion of the hole 76. A plunger chamber 78 is defined by the fixed core 77 and inner walls of the hole 76 at the lower portion of the hole 76 in the solenoid 62. A cylindrical steel plunger 79 is accommodated in the plunger chamber 78. The plunger 79 slides along the axis of the chamber 78. A second coil spring 80 extends between the plunger 79 and the bottom of the hole 76. The force of the second coil spring 80 is smaller than the force of the first coil spring 65. A second guide hole 81 is formed in the fixed core 77 between the plunger chamber 78 and the valve chamber 63. The axis of the second guide hole 81 is aligned with the axis of the first guide hole 73. A second rod 82 is formed integrally with the valve body 64 and projects downward from the bottom of the valve body 64. The second rod 82 is accommodated in and slides with respect to the second guide hole 81. The first spring 65 urges the valve body 64 downward, while the second spring 80 urges the plunger 79 upward. This allows the lower end of the second rod 82 to constantly contact the plunger 79. In other words, the valve body 64 moves integrally with the plunger 79 with the second rod 82 therebetween.

A small chamber 85 is defined by the inner wall of the rear housing 13 and the circumference of the valve 49 at a position corresponding to the third port 75. The small chamber 85 is connected to the valve hole 66 by the third port 75. A communication groove 83 is formed in a side of the fixed core 77, and opens in the plunger chamber 78. A communication hole 84 is formed in the middle portion of the housing 61 for communicating the groove 83 with the small chamber 85. The plunger chamber 78 is connected to the valve hole 66 by the groove 83, the small chamber 85, and the third port 75. This equalizes the pressure in the plunger chamber 78 with the pressure in the valve hole 66 (crank chamber pressure Pc). The plunger 79 is provided with a through hole 86 that communicates the upper portion of the plunger chamber 78 with the lower portion of the chamber 78.

A cylindrical coil 87 is wound around the fixed core 77 and the plunger 79. The driving circuit 60 provides the coil 87 with electric current based on commands from the computer 57. The computer 57 determines the magnitude of the current provided to the coil 87. A plate 90 made of magnetic material is accommodated in the bottom portion of the solenoid 62.

The operation of the above described compressor will now be described.

When the air conditioner starting switch 59 is on, if the temperature detected by the compartment temperature sensor 58*a* is higher than a target temperature set by the temperature adjuster 58, the computer 57 commands the driving circuit 60 to excite the solenoid 62. Accordingly, electric current having a certain magnitude is sent to the coil 87 from the driving circuit 60. This produces a magnetic attractive force between the fixed core 77 and the plunger 79, as illustrated in FIGS. 2 and 3, in accordance with the current magnitude. The attractive force is transmitted to the valve body 64 by the second rod 82 and thus urges the valve body 64 against the force of the first spring 65 in a direction closing the valve hole 66. On the other hand, the length of the bellows 70 varies in accordance with the suction pressure Ps in the suction passage 32 that is introduced to the pressure sensing chamber 68 via the pressure introduction passage 50. The changes in the length of the bellows 70 are transmitted to the valve body 64 by the first rod 74. The higher the suction pressure Ps is, the shorter the bellows 70 becomes. As the bellows 70 becomes shorter, the bellows 70 moves the valve body 64 in a direction closing the valve hole 66.

The opening area between the valve body 64 and the valve hole 66 is determined by the equilibrium of a plurality of forces acting on the valve body 64. Specifically, the opening area is determined by the equilibrium position of the body 64, which is affected by the force of the solenoid 62, which acts on the valve body 64 through the second rod 82, the force of the bellows 70, which acts on the valve body 64 through the first rod 74, and the force of the first spring 65.

Suppose the cooling load is great, the suction pressure Ps is high and the temperature in the vehicle compartment detected by the sensor 58*a* is higher than a target temperature set by the temperature adjuster 58. The computer 57 commands the driving circuit 60 to send a current to the coil 87 of the control valve 49 that is a function of difference between the detected temperature and the target temperature. In other words, the computer 57 increases the magnitude of the current sent to the coil 87 as the difference between the compartment temperature and the target temperature increases. This increases the attractive force between the fixed core 77 and the plunger 79, thereby increasing the resultant force that causes the valve body 64 to close the valve hole 66. This lowers the pressure Ps for moving the valve body 64 in a direction closing the valve hole 66. In other words, as the magnitude of the current to the control valve 49 is increased, the valve 49 functions such that the suction pressure Ps required to close the valve is decreased to a lower level.

A smaller opening area between the valve body 64 and the valve hole 66 decreases the amount of refrigerant gas flow from the discharge chamber 38 to the crank chamber 15 via the supply passage 48. The refrigerant gas in the crank chamber 15 flows into the suction chamber 37 via the pressure release passage 46 and the pressure release hole 47. This lowers the pressure Pc in the crank chamber 15. Further, when the cooling load is great, the suction pressure Ps is high. Accordingly, the pressure in each cylinder bore 11*a* is high. Therefore, the difference between the pressure Pc in the crank chamber 15 and the pressure in each cylinder bore 11*a* is small. This increases the inclination of the swash plate 22, thereby allowing the compressor to operate at a large displacement.

When the valve hole 66 in the control valve 49 is completely closed by the valve body 64, the supply passage 48 is closed. This stops the supply of the highly pressurized refrigerant gas in the discharge chamber 38 to the crank chamber 15. Therefore, the pressure Pc in the crank chamber 15 becomes substantially equal to the low pressure Ps in the suction chamber 37. The inclination of the swash plate 22 thus becomes maximum as shown in FIGS. 2 and 3, and the compressor operates at the maximum displacement. The abutment of the swash plate 22 against the projection 21*a* of the rotor 21 prevents the swash plate 22 from inclining beyond the predetermined maximum inclination.

Suppose the cooling load is small the suction pressure Ps is low, and the difference between the compartment temperature detected by the sensor 58*a* and a target temperature set by the temperature adjuster 58 is small. In this state, the computer 57 commands the driving circuit 60 to send a current having a smaller magnitude to the coil 87 of the control valve 49. In other words, the computer 57 decreases the magnitude of the current sent to the coil 87 as the difference between the compartment temperature and the target temperature becomes smaller. This decreases the attractive force between the fixed core 77 and the plunger 79, thereby decreasing the resultant force that moves the valve body 64 in a direction closing the valve hole 66. This raises the pressure Ps for moving the valve body 64 in a direction closing the valve hole 66. In other words, as the magnitude of the current to the control valve 49 is decreased, the valve 49 functions such that the pressure Ps required to close the valve 49 is increased to a higher level.

A larger opening area between the valve body 64 and the valve hole 66 increases the amount of refrigerant gas flow from the discharge chamber 38 to the crank chamber 15. This increases the pressure Pc in the crank chamber 15. Further, when the cooling load is small, the suction pressure Ps is low and the pressure in the cylinder bores 11*a* is low. Therefore, the difference between the pressure Pc in the crank chamber 15 and the pressure in the cylinder bores 11*a* is great. This decreases the inclination of the swash plate 22. The compressor thus operates at a small displacement.

As the cooling load approaches zero, the temperature of the evaporator 55 in the external refrigerant circuit 52 drops to a frost forming temperature. When the temperature sensor 56 detects a temperature that is equal to or lower than the frost forming temperature, the computer 57 commands the driving circuit 60 to de-excite the solenoid 62. The driving circuit 60 stops sending current to the coil 87, accordingly. This stops the magnetic attractive force between the fixed core 77 and the plunger 79. The valve body 64 is then moved by the force of the first spring 65 against the weaker force of the second spring 80 transmitted by the plunger 79 and the second rod 82. In other words, the valve body 64 is moved in a direction opening the valve hole 66. This maximizes the opening area between the valve body 64 and the valve hole 66. Accordingly, the gas flow from the discharge chamber 38 to the crank chamber 15 is increased. This further raises the pressure Pc in the crank chamber 15, thereby minimizing the inclination of the swash plate 22. The compressor thus operates at the minimum displacement.

When the switch 59 is turned off, the computer 57 commands the driving circuit 60 to de-excite the solenoid 62. This minimizes the inclination of the swash plate 22.

As described above, when the magnitude of the current to the coil 87 is increased, the valve body 64 functions such that the opening area of the valve hole 66 is closed by a lower suction pressure Ps. When the magnitude of the current to the coil 87 is decreased, on the other hand, the valve body 64 functions such that the opening area of the valve hole 66 is closed by a higher suction pressure Ps. In other words, a greater magnitude of current to the coil 87 sets the suction pressure Ps for closing the opening area of the valve hole 66 to a lower level. Contrarily, a smaller magnitude of current to the coil 87 sets the suction pressure Ps for closing the opening area of the valve hole 66 to a higher level. The compressor controls the inclination of the swash plate 22 to adjust its displacement, thereby maintaining the valve shutting value of the suction pressure Ps.

Accordingly, the functions of the control valve 49 include changing the valve shutting value of the suction pressure Ps in accordance with the magnitude of the supplied current and allowing the compressor to operate at the minimum displacement at any given suction pressure Ps. A compressor equipped with the control valve 49 having such functions varies the cooling ability of the air conditioner and is efficiently operated in accordance with cooling load.

The shutter 28 slides in accordance with the tilting motion of the swash plate 22. As the inclination of the swash plate 22 decreases, the shutter 28 gradually reduces the cross-sectional area of the passage between the suction passage 32 and the suction chamber 37. This gradually reduces the amount of refrigerant gas that enters the suction chamber 37 from the suction passage 32. The amount of refrigerant gas that enters the cylinder bores 11*a* from the suction chamber 37 gradually decreases, accordingly. As a result, the displacement of the compressor gradually decreases. This gradually lowers the discharge pressure Pd of the compressor. The load torque of the compressor gradually decreases, accordingly. In this manner, the load torque for operating the compressor does not change dramatically in a short time when the displacement decreases from the maximum to the minimum. The shock that accompanies load torque fluctuations is therefore lessened.

When the inclination of the swash plate 22 is minimum, the shutter 28 abuts against the positioning surface 33. This prevents the inclination of the swash plate 22 from being smaller than the predetermined minimum inclination. The abutment also disconnects the suction passage 32 from the suction chamber 37. This stops the gas flow from the external refrigerant circuit 52 to the suction chamber 37, thereby stopping the circulation of refrigerant gas between the circuit 52 and the compressor.

The minimum inclination of the swash plate 22 is slightly larger than zero degrees. Zero degrees refers to the angle of the swash plate's inclination when it is perpendicular to the axis of the drive shaft 16. Therefore, even if the inclination of the swash plate 22 is minimum, refrigerant gas in the cylinder bores 11*a* is discharged to the discharge chamber 38 and the compressor operates at the minimum displacement. The refrigerant gas discharged to the discharge chamber 38 from the cylinder bores 11*a* enters the crank chamber 15 through the supply passage 48. The refrigerant gas in the crank chamber 15 is drawn back into the cylinder bores 11*a* through the pressure release passage 46, a pressure release hole 47 and the suction chamber 37. That is, when the inclination of the swash plate 22 is minimum, refrigerant gas circulates within the compressor traveling through the discharge chamber 38, the supply passage 48, the crank chamber 15, the pressure release passage 46, the pressure release hole 47, the suction chamber 37 and the cylinder bores 11*a*. This circulation of refrigerant gas allows the lubricant oil contained in the gas to lubricate the moving parts of the compressor.

If the switch 59 is on and the inclination of the swash plate 22 is minimum, an increase in the compartment temperature increases the cooling load. In this case, the temperature detected by the compartment temperature sensor 58*a* is higher than a target temperature set by the compartment temperature adjuster 58. The computer 57 commands the driving circuit 60 to excite the solenoid 62 based on the detected temperature increase. When the solenoid 62 is excited, the supply passage 48 is closed. This stops the flow of refrigerant gas from the discharge chamber 38 into the crank chamber 15. The refrigerant gas in the crank chamber 15 flows into the suction chamber 37 via the pressure release passage 46 and the pressure release hole 47. This gradually lowers the pressure Pc in the crank chamber 15, thereby moving the swash plate 22 from the minimum inclination to the maximum inclination.

As the inclination of the swash plate 22 increases, the force of the spring 29 gradually pushes the shutter 28 away from the positioning surface 33. This gradually enlarges the cross-sectional area of the passage between the suction passage 32 and the suction chamber 37. Accordingly, the amount of refrigerant gas flow from the suction passage 32 into the suction chamber 37 gradually increases. Therefore, the amount of refrigerant gas that enters the cylinder bores 11*a* from the suction chamber 37 gradually increases. The displacement of the compressor gradually increases, accordingly. The discharge pressure Pd of the compressor gradually increases and the torque for operating the compressor also gradually increases. In this manner, the torque of the compressor does not dramatically change in a short time when the displacement changes from the minimum to the maximum. The shock that accompanies load torque fluctuations is thus lessened.

If the engine E is stopped, the compressor is also stopped, that is, the rotation of the swash plate 22 is stopped, and the supply of current to the coil 87 in the control valve 49 is stopped. This de-excites the solenoid 62, thereby opening the supply passage 48. In this state, the inclination of the swash plate 22 is minimum. If the nonoperational state of the compressor continues, the pressures in the chambers of the compressor become equalized and the swash plate 22 is kept at the minimum inclination by the force of spring 26. Therefore, when the engine E is started again, the compressor starts operating with the swash plate at the minimum inclination. This requires the minimum torque. The shock caused by starting the compressor is thus reduced.

Exciting the solenoid 62 produces a magnetic attractive force between the fixed core 77 and the plunger 79. The attractive force is transmitted to the valve body 64 by the second rod 82, thereby moving the valve body 64 in a direction closing the valve hole 66 as illustrated in FIG. 3. Fluctuations of the suction pressure Ps expands or collapses the bellows 70. Changes in the length of the bellows 70 are transmitted to the valve body 64 by the first rod 74 (except under the conditions illustrated in FIG. 5).

An increase in the suction pressure Ps in the pressure sensing chamber 68 collapses the bellows 70. The deformation direction of the bellows 70 is the same as the direction in which the excited solenoid 62 urges the valve body 64. The valve body 64 thus follows the deformation of the bellows 70 in a direction closing the valve hole 66. This decreases the opening area of the valve hole 66, thereby decreasing the amount of refrigerant gas flow from the discharge chamber 38 to the crank chamber 15. Accordingly, the inclination of the swash plate is increased.

A decrease in the suction pressure Ps in the pressure sensing chamber 68 expands the bellows 70. The bellows 70 thus moves the valve body 64 against the force of the solenoid 62 in a direction opening the valve hole 66. This increases the opening area of the valve hole 66, thereby increasing the amount of refrigerant gas flow from the discharge chamber 38 to the crank chamber 15. Accordingly, the inclination of the swash plate is decreased.

Figure 5:
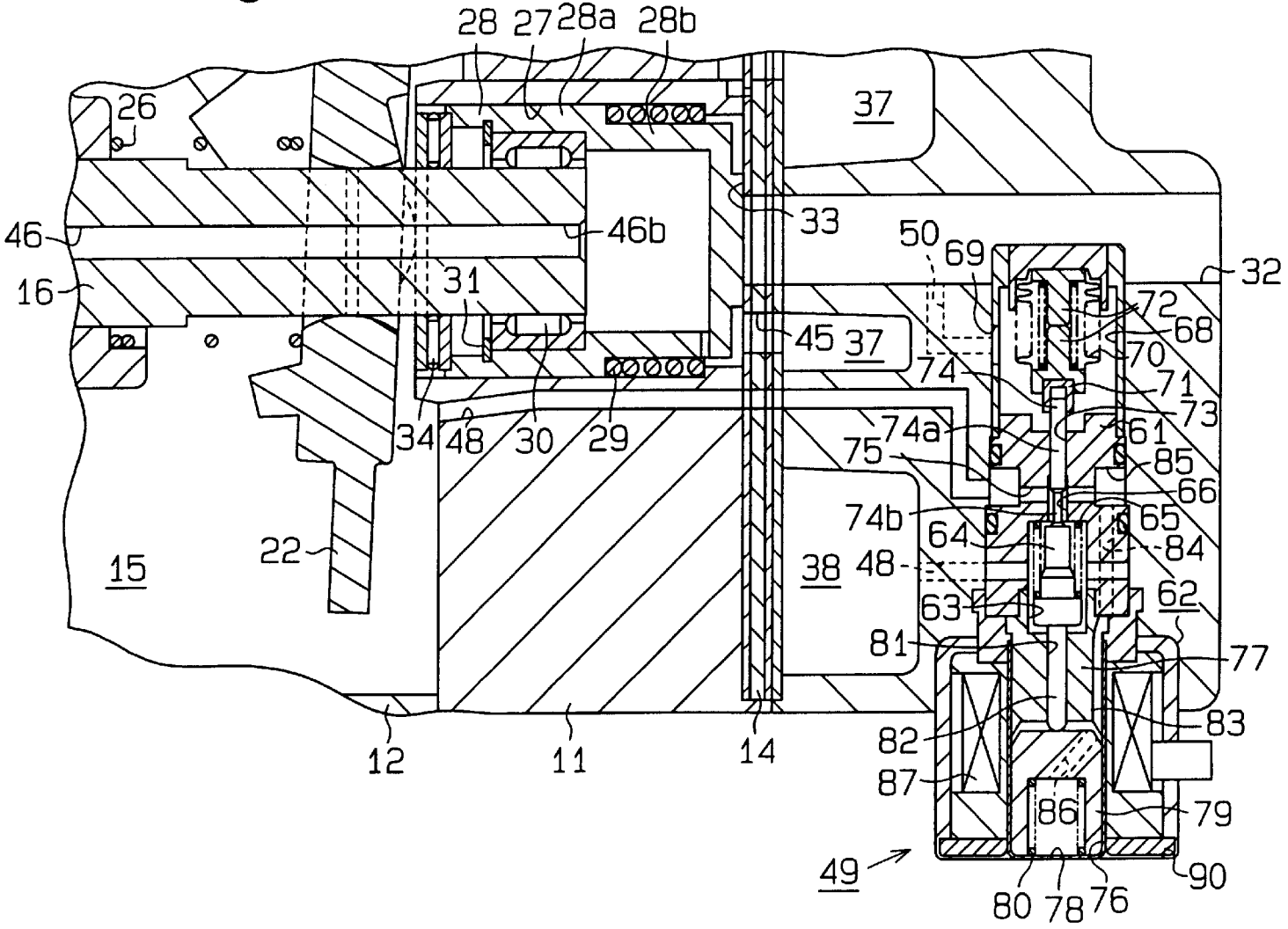
FIG. 5 is an enlarged partial cross-sectional view illustrating the compressor of FIG. 4 when high suction pressure is introduced to a pressure sensing chamber.
Figure 6:
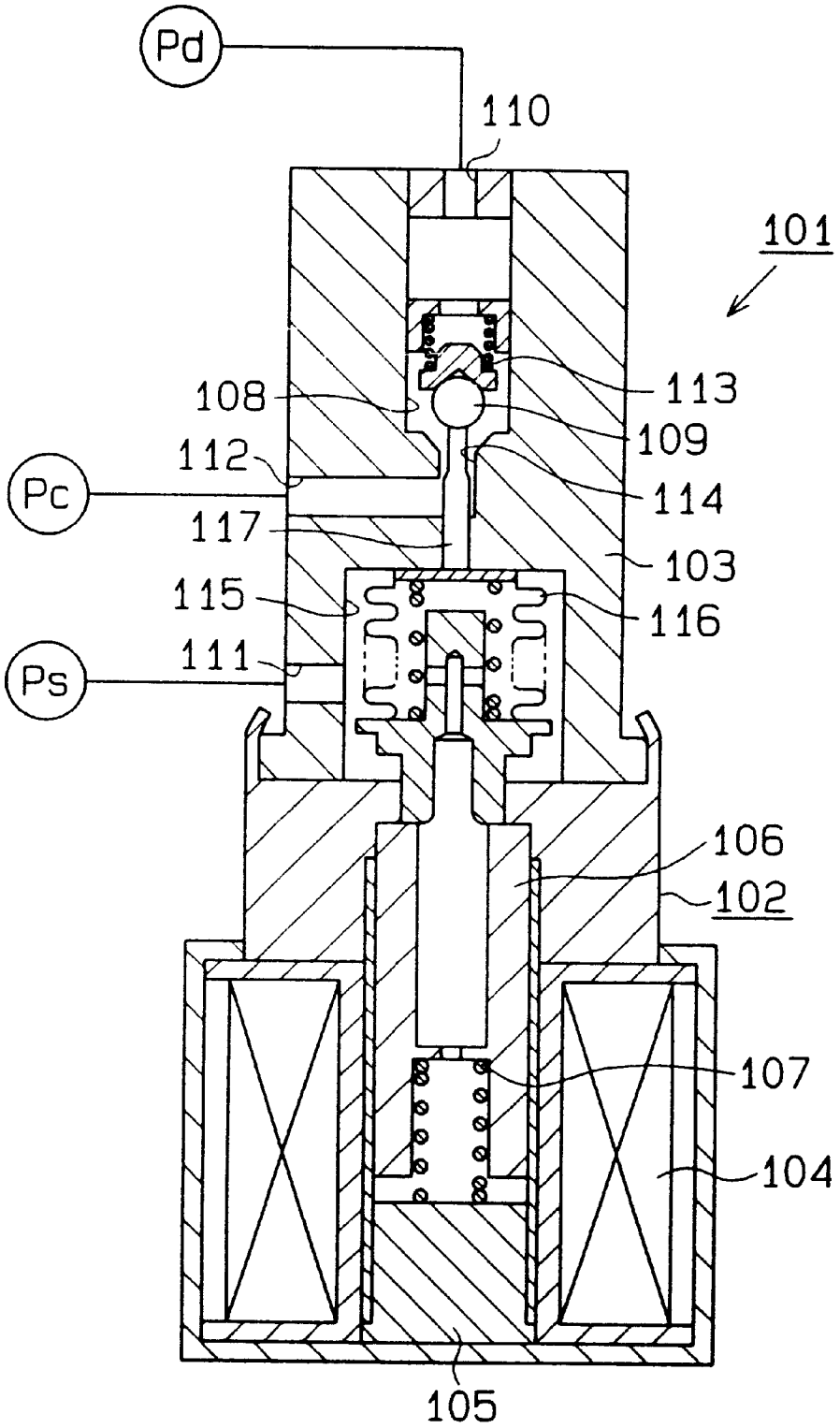
Fig.6 (Prior Art)
FIG. 6 is a cross-sectional view illustrating a prior art control valve.

Contrarily, de-exciting the solenoid 62 produces no attractive force between the fixed core 77 and the plunger 79. In this case, the force of the first spring 65 urges the valve body in a direction opening the valve hole 66. An increase in the suction pressure Ps in the pressure sensing chamber 68 collapses the bellows 70 as shown in FIG. 5. The deformation direction of the bellows 70 is opposite to the direction in which the first spring 65 urges the valve body 64. However, the upper end of the first rod 74 in the control valve 49 is slidably received by the receiver 71, which is secured to the bellows 70. This allows the valve body 64 and the bellows 70 to separate from or to approach each other. Therefore, when the solenoid 62 is de-excited and the suction pressure Ps is high, the valve body 64 and the bellows 70 separate from each other as shown in FIG. 5. The deformation of the bellows 70 is thus not transmitted to the valve body 64. In other words, the valve body 64 is not affected by the high suction pressure Ps when the solenoid 62 is de-excited, but is moved by the force of the first spring 65 in a direction opening the valve hole 66. Accordingly, the opening area of the valve hole 66 is maximized. This allows the compressor to operate at the minimum displacement when suction pressure Ps is high.

The drive shaft 16 of a clutchless type variable displacement compressor is directly connected to the external drive source E. This compressor keeps operating at the minimum displacement even if there is no cooling load. The control valve 49 according to this embodiment allows compressors to operate at the minimum displacement when suction pressure Ps is high. Therefore, control valve 49 is suitable for clutchless type variable displacement compressors.

A pair of stoppers 72 are arranged facing each other in the bellows 70. When suction pressure Ps is high, the stoppers 72 abuts against each other, thereby preventing the bellows 70 from collapsing beyond a predetermined maximum deformation amount. Further, the hole of the receiver 71 has such a depth that the upper end of the first rod 74 stays in the receiver 71 even if the bellows 70 and the valve body 64 are separated by the maximum distance. In other words, the first rod 74 is prevented from being dislocated from the receiver 71. This stabilizes the operation of the valve body 64 and the bellows 70.

The present invention may be alternatively embodied in the following forms:

(1) The third port 75 may be connected to the discharge chamber 38 by the supply passage 48, and the first port 67 may be connected to the crank chamber 15 by the supply passage 48.

(2) Instead of the bellows 70, a diaphragm may be used as the pressure sensing member. In this case, the receiver 71 is provided on a side of the diaphragm, and an end of the first rod 74 is slidably inserted in the receiver 71. When suction pressure Ps is high and the solenoid 62 is de-excited, the valve body 64 is located at such a position that the opening area of the valve hole 66 is maximized. The compressor thus operates at the minimum displacement.

(3) The first rod 74 and the valve body 64 may be either integrally or separately manufactured.

(4) The second spring 80 between the plunger 79 and the bottom of the accommodating hole 76 may be omitted.

(5) Instead of the through hole 86, a groove may be formed in the surface of the plunger 79 for communicating the upper portion of the plunger chamber 78 with the lower portion of the chamber 78.

Therefore, the present examples and embodiments are to be considered as illustrative and not restrictive and the invention is not to be limited to the details given herein but may be modified within the scope of the appended claims.

What is claimed is:

1. A control valve in a variable displacement compressor that adjusts the discharge displacement by controlling an inclination of a cam plate located in a crank chamber, wherein said compressor includes a piston operably coupled to the cam plate and located in a cylinder bore, said piston compressing gas supplied to the cylinder bore from a first area and discharging the compressed gas to a second area, the inclination of the cam plate is variable based on the pressure in the crank chamber, and a supply passage for connecting the second area with the crank chamber, wherein said control valve is placed midway on the supply passage for adjusting the amount of the gas introduced into the crank chamber from the second area through the supply passage to control the pressure in the crank chamber, said control valve comprising:

a valve body for adjusting the opening size of the supply passage, said valve body moves in a first direction and a second direction opposite to the first direction, wherein said valve body moves in the first direction to open the supply passage, and wherein said valve body moves in the second direction to close the supply passage;

a reacting member for reacting to the pressure in the first area;

a first transmitting member placed between the reacting member and the valve body, wherein said reacting member allows the valve body to move in the second direction via the first transmitting member when the pressure in the first area is raised;

a solenoid opposed to the reacting member with respect to the valve body;

a second transmitting member placed between the solenoid and the valve body, wherein said solenoid urges the valve body in the second direction via the second transmitting member when the solenoid is excited;

means for urging the valve body in the first direction; and said first transmitting member connecting the reacting member with the valve body to move the valve body toward or away from the reacting member, whereby said urging means causes the valve body to fully open the supply passage when the solenoid is de-excited and said first transmitting member prevents said reacting member from moving the valve body in the second direction when the solenoid is de-excited.

2. The control valve according to claim 1, wherein said first transmitting member includes a rod having a first end, wherein said reacting member has a support member for slidably supporting the first end.

3. The control valve according to claim 2, wherein said support member has a bore for slidably receiving the first end.

4. The control valve according to claim 2, wherein said rod has a second end fixed to the valve body.

5. The control valve according to claim 2, wherein said support member has a length for preventing the rod from being separated from the support member when the reacting member and the valve body move away from each other.

6. The control valve according to claim 2, wherein said reacting member is collapsible within a predetermined range.

7. The control valve according to claim 6 further comprising:

a housing having a pressure chamber connected with the first area;

said reacting member including a bellows located in the pressure chamber, said bellows being arranged to be collapsed in accordance with raising of the pressure in the first area and expanded in accordance with decreasing of the pressure in the first area; and a pair of stoppers arranged facing each other in the bellows, wherein said stoppers prevent the bellows from excessive collapse when the stoppers abut against each other.

8. The control valve according to claim 1, wherein said solenoid biases the valve body with a force generated by a magnitude of electric current sent to the solenoid.

9. The control valve according to claim 8, wherein said solenoid has a fixed core and a plunger facing the core to move toward or away from the core, wherein the current sent to the solenoid produces a magnetic attractive force between the core and the plunger in accordance with the magnitude of the current, wherein said second transmitting member is placed between the plunger and the valve body to bias the valve body by the magnetic attractive force.

10. The variable displacement compressor having the control valve according to claim 1 further comprising:

a drive shaft for driving the cam plate; and an external driving source coupled directly to the drive shaft to rotate the drive shaft.

11. A control valve in a variable displacement compressor that adjusts the discharge displacement by controlling an inclination of a cam plate located in a crank chamber, wherein said compressor includes a piston operably coupled to the cam plate and located in a cylinder bore, said piston compressing gas supplied to the cylinder bore from a first area and discharging the compressed gas to a second area, the inclination of the cam plate is variable based on the pressure in the crank chamber, and a supply passage for connecting the second area with the crank chamber, wherein said control valve is placed midway on the supply passage for adjusting the amount of the gas introduced into the crank chamber from the second area through the supply passage to control the pressure in the crank chamber, said control valve comprising:

a housing having a valve hole disposed midway on the supply passage and a pressure chamber connected with the first area;

a valve body for adjusting the opening size of the valve hole, said valve body moves in a first direction and a second direction opposite to the first direction, wherein said valve body moves in the first direction to open the valve hole, and wherein said valve body moves in the second direction to close the valve hole;

a reacting member located in the pressure chamber for reacting to the pressure in the pressure chamber;

a transmitting rod placed between the reacting member and the valve body, wherein said reacting member allows the valve body to move in the second direction via the rod when the pressure in the pressure chamber is raised;

a solenoid opposed to the reacting member with respect to the valve body;

a transmitting member placed between the solenoid and the valve body, wherein said solenoid urges the valve body in the second direction via the transmitting member with a force generated by a magnitude of electric current sent to the solenoid when the solenoid is excited;

means for urging the valve body in the first direction; and said rod connecting the reacting member with the valve body to move the valve body toward or away from the reacting member, said rod having a first end, wherein said reacting member has a support member for slidably supporting the first end, whereby said urging means causes the valve body to fully open the valve hole when the solenoid is de-excited and said slidable support of the first end by the support member prevents said reacting member from moving the valve body in the second direction when the solenoid is de-excited.

12. The control valve according to claim 11, wherein said support member has a bore for slidably receiving the first end of said rod.

13. The control valve according to claim 11, wherein said rod has a second end fixed to the valve body.

14. The control valve according to claim 11, wherein said support member has a length for preventing the rod from being separated from the support member when the reacting member and the valve body move away from each other.

15. The control valve according to claim 14, wherein said reacting member is collapsible within a predetermined range.

16. The control valve according to claim 15 further comprising:

said reacting member including a bellows, said bellows being arranged to be collapsed in accordance with raising of the pressure in the pressure chamber and expanded in accordance with decreasing of the pressure in the pressure chamber; and a pair of stoppers arranged facing each other in bellows, wherein said stoppers prevent the bellows from excessive collapse when the stoppers abut against each other.

17. The control valve according to claim 11, wherein said solenoid has a fixed core and a plunger facing the core to move toward or away from the core, wherein the current sent to the solenoid produces a magnetic attractive force between the core and the plunger in accordance with the magnitude of the current, wherein said transmitting member is placed between the plunger and the valve body to bias the valve body by the magnetic attractive force.

18. The variable displacement compressor having the control valve according to claim 11 further comprising:

a drive shaft for driving the cam plate; and an external driving source coupled directly to the drive shaft to rotate the drive shaft.

* * * * *

UNITED STATES PATENT AND TRADEMARK OFFICE

CERTIFICATE OF CORRECTION

PATENT NO. : 5,964,578

DATED : October 12, 1999

INVENTOR(S) : Ken SUITOU et al.

It is certified that error appears in the above-identified patent and that said Letters Patent is hereby corrected as shown below:

Title page, first column, under "[75] Inventors:", correct the spelling of an inventor's name.

"Nagayoski" should be --Nagayoshi--

Signed and Sealed this

Fifteenth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 5,964,578
DATED : October 12, 1999
INVENTOR(S) : Ken Suitou et al.

It is certified that error appears in the above-identified patent and that said Letters Patent is hereby corrected as shown below:

Title page,
Item [73], Assignee, add a joint assignee:
-- NOK Corporation, Tokyo, Japan --

Signed and Sealed this

Twentieth Day of August, 2002

*Attest:*

*Attesting Officer*

JAMES E. ROGAN
*Director of the United States Patent and Trademark Office*